United States Patent [19]

Martin

[11] 4,330,979

[45] May 25, 1982

[54] SPACE DIVIDERS

[75] Inventor: Thomas J. Martin, Vancouver, Canada

[73] Assignee: MacMillan Bloedel Limited, Vancouver, Canada

[21] Appl. No.: 168,028

[22] Filed: Jul. 14, 1980

Related U.S. Application Data

[62] Division of Ser. No. 43,751, May 30, 1979, Pat. No. 4,226,357.

[30] Foreign Application Priority Data

Mar. 5, 1979 [CA] Canada ..... 322764

[51] Int. Cl.[3] ..... B65B 21/14; B65B 21/02

[52] U.S. Cl. ..... 53/452; 53/467; 53/468; 414/786

[58] Field of Search ..... 53/467, 468, 458, 452, 53/381 R, 492, 474, 473, 475; 414/416, 786

[56] References Cited

U.S. PATENT DOCUMENTS

| | | | |
|---|---|---|---|
| 2,698,708 | 1/1955 | Margolies | 229/28 |
| 3,258,808 | 7/1966 | Ashford | 414/416 X |
| 3,553,927 | 1/1971 | Anglade, Jr. | 53/473 X |
| 3,749,299 | 7/1973 | Ingle | 229/15 |
| 3,753,509 | 8/1973 | Kock | 414/416 |
| 3,777,445 | 12/1973 | Anderson | 53/580 X |

*Primary Examiner*—Horace M. Culver
*Attorney, Agent, or Firm*—Sim & McBurney

[57] ABSTRACT

Disclosed is a method of handling bottles utilizing a special rectangular, closed bottom, carton and divider combination. The divider has a depth less than the distance from the base to the top of the carton, and has partition members defining a plurality of partitioned spaces, including at least one main partition extending fully between two opposed side walls of the carton. The main partition has two projecting fingers, one at each end of the main partition, and the said opposed side walls of the carton have two pairs of apertures located so that the partition fingers will mate with a first pair of apertures when the divider is in a first position, and with a second pair when the divider is in a second position. The method involves placing the divider in the carton in the first position, loading a plurality of bottles into the carton in the spaces defined by the divider with the neck portions down so that the base portions are protected from scraping against each other by the presence of the divider, closing the carton top portion and shipping the carton and its contents to a filling location, at the filling location opening the carton top to remove the items and fill and cap them, moving the divider in the carton from the first to the second position, loading the filled and capped bottles back into the container with the base portions down so that again the base portions are protected from scraping against each other by the presence of the divider, and closing the carton top portion for further shipment of the now filled bottles.

1 Claim, 10 Drawing Figures

SPACE DIVIDERS

This is a divisional of U.S. Patent Application 043,751 filed May 30, 1979, and now U.S. Pat. No. 4,226,357, entitled IMPROVEMENTS IN SPACE DIVIDERS.

This invention relates generally to what are known as space dividers or cellular fillers for cartons made of cardboard or other sheet material. Usually, these space dividers are formed from blanks of sheet material such as cardboard, chipboard or the like, by a process in which the blank is impressed with fold lines, lines of weakness, severable lines of weakness, and complete slits at various appropriate places. The process by which these lines are impressed upon the blank normally includes gluing and folding procedures in which various tabs, panels, and so forth are juxtaposed and attached to each other, such that when the space divider is "set up" it will define the desired divided spaces into which items such as bottles, cans, and the like may be placed when the space divider is located in a carton of a suitable size.

BRIEF DESCRIPTION OF THE PRIOR ART

Typical examples of prior space dividers can be found in U.S. Pat. Nos. 4,108,349, Pfaffendorf, issued Aug. 22, 1978; 2,782,951, Inman, issued Feb. 26, 1957; 3,982,684, David, issued Sept. 28, 1976; 3,985,286, Hicks, issued Oct. 12, 1976; 4,096,984, Gardner, issued June 27, 1978; 4,120,442, Skaggs, issued Oct. 17, 1978; 4,030,660, Rada et al, issued June 21, 1977; and 3,756,496, Ooskdik, issued Sept. 4,1973.

While the inventions disclosed in these prior patents are meritorious enough, it can be generally observed that the way in which the cardboard or chipboard is utilized to form the space dividers is often wasteful of material, due to the use of a design in which two panels are juxtaposed and glued or otherwise fastened together. It would be more efficient in terms of material usage to employ a design in which no overlapping or duplication is involved, and the provision of a design of this kind is one of the aspects disclosed herein.

It is also generally observed in the prior art that, in many cases, the walls of the external carton itself are not sufficiently used to help define partitioned spaces within the carton. The provision of a design making good use of such a function of the external carton is another aspect disclosed herein.

A problem which has been encountered in the manufacture of conventional space dividers from an original single blank relates to the difficulty and complexity associated with the folding of a blank in a zig-zag pattern. This is due to the inherent structure of the processing machine, which structure is such that the machine finds it easier simply to fold a certain edge or end portion of the blank inwardly toward the middle, without at the same time having to fold a marginal portion back outwardly to form a "Z" or zig-zag shape. The provision of a design which permits a machine to avoid having to fold the blank in a zig-zag formation is another aspect disclosed herein.

In the area of bottle-shipping, it is common to utilize the same carton to send empty bottles to a filling installation as is used to ship the later filled bottles to a wholesaling or retailing outlet. Commonly, the empty bottles are shipped upside down in the carton. The carton typically will have a bottom end, which remains the bottom end due to the fact that it is closed and possibly taped together. The top end is openable for loading the bottles and for removing them. Thus, in shipping the empty bottles to the filling installation, the bottles are placed upside down, with the smaller necks toward the bottom and the larger bases toward the top, so that at the filling installation the bottles can be removed by equipment adapted to seize the bottom end of each bottle. After the bottles have been filled and capped, they are then returned to the carton, again by automatic equipment, this time with the larger bases downwardly. Because the larger diameter bases are firstly in the uppermost position and secondly in the lowermost position in the same carton, any space divider which is provided has conventionally been made long enough to be able to separate the bottles from each other whether loaded upside down or right side up. Usually, this involves the provision of a space divider which has a depth the same as the height of the carton.

Such space dividers are used only a portion at a time. In other words, the upper portion is used during shipping of the empty bottles, and the lower portion is used during shipping of the filled and capped bottles. This is wasteful of divider material, since it is conceivable that a space divider could be constructed which would have a depth less than the height of the carton, and would be positioned at the upper end for shipment of the empty bottles and at the lower end for shipment of the filled and capped bottles. This invention contemplates the provision of such a space divider, and of specific interfitting means for locating the space divider at the upper or lower portion of the carton, as desired.

GENERAL DESCRIPTION OF THIS INVENTION

Accordingly, this invention provides a method of handling and shipping bottle-like items having lower base portions of longer diameter and upper neck portions of smaller diameter, including the steps:

(1) providing a carton and space divider combination in which the carton is rectangular in section with four side walls, a closed base and an openable top portion, the divider having a depth less than the distance from the carton base to the carton top portion, and having partition members defining a plurality of partitioned spaces, including at least one main partition extending fully between two opposed side walls of the carton, the main partition having two projecting fingers, one at each end of the main partition, the said opposed side walls having (a) a first pair of apertures located so that the said fingers can register therewith when the divider is in a first position in the carton, and (b) a second pair of apertures aligned with but spaced from said first pair such that the divider can be moved to a second position to bring the fingers into registry with said second pair, the divider in the first position being adjacent the top portion of the carton, the divider in the second position being adjacent the base of the carton, (2) placing the divider in the carton in said first position, (3) loading a plurality of said bottle-like items into the carton in the spaces defined by said divider, with the neck portions down so that the base portions are protected from scraping against each other by the presence of the divider, (4) closing the carton top portion and shipping the carton and its contents to a filling location, (5) at the filling location, opening the carton top, removing the said items, and filling and capping them, (6) moving the divider in the carton from said first to said second position, (7) loading the filled and capped bottle-like items back into the container with the base portions down so that again the base portions are protected from scraping against each other by the presence of the divider, and (8) closing the carton top portion for further shipment of the now filled bottle-like members.

BRIEF DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
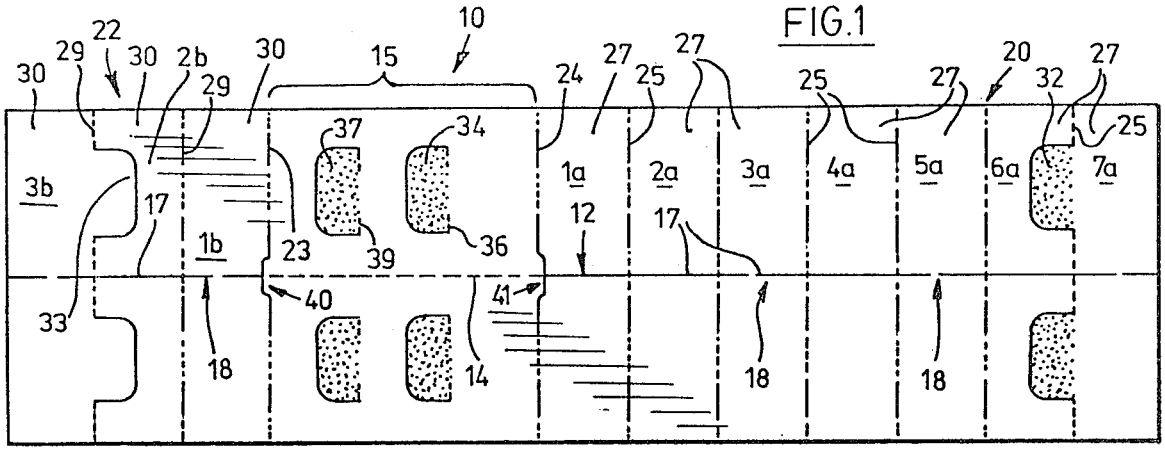
FIG. 1 shows a blank prior to folding, utilized in the construction of the space divider of this invention.

Referring first to FIG. 1, the divider of this invention is constructed from a blank 10 which has a long dimension seen as horizontal in the figure, and a short dimension seen as vertical in the figure. The blank 10 is divided longitudinally by a line 12, into two identical halves. The method in accordance with this invention may be viewed as being applicable to only one of the halves in isolation from the other. Such a procedure would yield a space divider capable of dividing off six spaces within an appropriately sized carton. The utilization of both halves shown in FIG. 1, the halves being hinged together in a manner which will be subsequently described, yields a space divider capable of defining twelve partitioned spaces within a carton of the appropriate dimensions. In the subsequent detailed description of the folding and gluing steps to be applied to the blank 10, the language utilized will refer to only one half of the blank of FIG. 10, it being understood that in the normal operation both halves of the blank would be treated identically and simultaneously.

The line 12 which divides the blank 10 longitudinally into two identical halves is in the form of a nonseverable fold-line 14 in the region of an internal portion 15 which will correspond to a base partition, as it will also later be called, in the completed space divider. In all other locations of the blank 10, the line 12 is in the form of aligned slits 17, separated by rupturable bridges 18.

The discussion now to follow will refer only to the upper half of the FIG. 1 blank 10. Within the blank are provided a number of lines of weakness, which divide off the internal portion 15 within a first end portion 20 of the blank, and a second end portion 22. The end portions 20 and 22 are on either side of the internal portion 15. Two lines of weakness 23 and 24 are located at either end of the internal portion 15 and constitute fold lines.

In the righthand end portion 20 of the blank there are located, at intervals, six further lines of weakness 25, which are arranged at intervals corresponding to the size of the desired partitioned spaces, the lines 25 thus defining in the end portion 20 seven panels 27 between the fold lines constituted by the lines of weakness 25.

Within the leftward end portion 22 of the blank are provided two additional lines of weakness 29, again at intervals corresponding to the size of the partitioned spaces, the lines 29 thus dividing the other end portion 22 into three panels 30.

In the upper half of the blank 10 shown in FIG. 1, the panels 27 in the rightward end portion 20 are numbered within the panels, using the numbers 1*a*–7*a*, consecutively outwardly from the internal portion 15. The panels 30 of the leftward end portion 22 are numbered 1*b*, 2*b* and 3*b*, consecutively outwardly from the internal portion 15.

As can be seen, there is provided, in the sixth panel 6*a* of the rightward end portion 20, a tab 32 which is adjacent the fold line 25 between the sixth and seventh panels 6*a* and 7*a*, the tab 32 being stiff with respect to the seventh panel 7*a*, i.e. being such that the line of weakness 25 between the panels 6*a* and 7*a* does not extend through the base of the tab 32. The tab itself is defined by a clean slit, so that the tab 32 is not connected in any way to the panel 6*a*.

There is also provided, in the second panel 2*b* of the other end portion 22, a tab 33 which is adjacent the fold line 29 between the second and third panels 2*b* and 3*b*, the tab 33 being stiff with respect to the third panel 3*b*. In other words, the line of weakness 29 between the panels 2*b* and 3*b* does not extend through the base of the tab 33. The line defining the outline of the tab 33 is a clean slit, so that the tab 33 is not connected in any way to the panel 2*b*.

Within the internal portion 15 is provided a first pliable tab 34 which is adjacent a first theoretical line 36 spaced inwardly from the rightward margin of the internal portion 15 by a distance corresponding to the size of the desired partitioned spaces, the tab 34 lying to the side of the first theoretical line 36 which is remote from the rightward end portion 20. The tab 34 is made pliable by virtue of partial lines of weakness extending in from its two extreme ends. The solid line definition of the tab 34 represents a clean slit such that the tab 34, other than along its base (the line 36) is not connected to the internal portion 15.

A second pliable tab 37 is also provided within the internal portion, the second pliable tab 37 being adjacent a second theoretical line 39 which is spaced in from the leftward end portion 22 by a distance corresponding to the size of the desired partitioned spaces, the tab 37 lying to the side of the second theoretical line 39 which is remote from the rightward end portion 20.

In the foregoing discussion we have been comparing the distances between the fold lines of the panels and the theoretical lines which define the bases of the tabs 34 and 37 to the size of the desired partitioned spaces. In the actual embodiment shown in the figure, all of the panels have exactly the same width, and the internal portion 15 has a width equal to exactly three panels. Moreover, the theoretical lines 36 and 39 are also separated from each other and from the rightward and leftward edges of the internal portion 15 by a distance equal to the width of a panel.

However, it should be understood that the space divider of this invention is capable of modification so that the individual rectangular spaces defined by the space divider are not square (as they would be with the construction shown in FIG. 1). The spaces could be made rectangular, with a longer dimension and a shorter dimension, by ensuring that all odd-numbered panels (using the numerical designations shown in FIG. 1) have a first width, and that all even-numbered panels have a second width. The width of the internal portion 15 would have to be made equal to three of the even-numbered panel widths. This would produce a series of divided or partitioned spaces which would be rectangular and which would have one dimension corresponding to the width of the even-numbered panels, and another dimension corresponding to the width of the odd-numbered panels.

Still referring only to the upper half of the blank 10 shown in FIG. 1, the next step after providing the lines of weakness (fold lines) and the various tabs is to apply glue or similar adhesion medium to the tab 32 in the sixth panel and to the second pliable tab 37. In FIG. 1, these two tabs have been stippled to denote the gluding procedure.

Next, and in any order, two folding procedures are carried out. In one of these procedures, the outer three panels 5*a*, 6*a* and 7*a* of the rightward end portion 20 are folded inwardly about the fold line between the fourth and fifth panels 4*a* and 5*a*, in order to adhere the third panel 3*a* to the tab 32 in the sixth panel 6*a*. In the other folding procedure, the outer two panels 2*b* and 3*b* of the leftward end portion 22 are folded inwardly about the fold line between the first and second panels 1*b* and 2*b*, in order to adhere the third panel 3*b* to the second pliable tab 37.

The second of the two procedures just mentioned will cause the tab 33 to be in an inverted position, so that the back of the tab 33 is upwardly.

Figure 2:
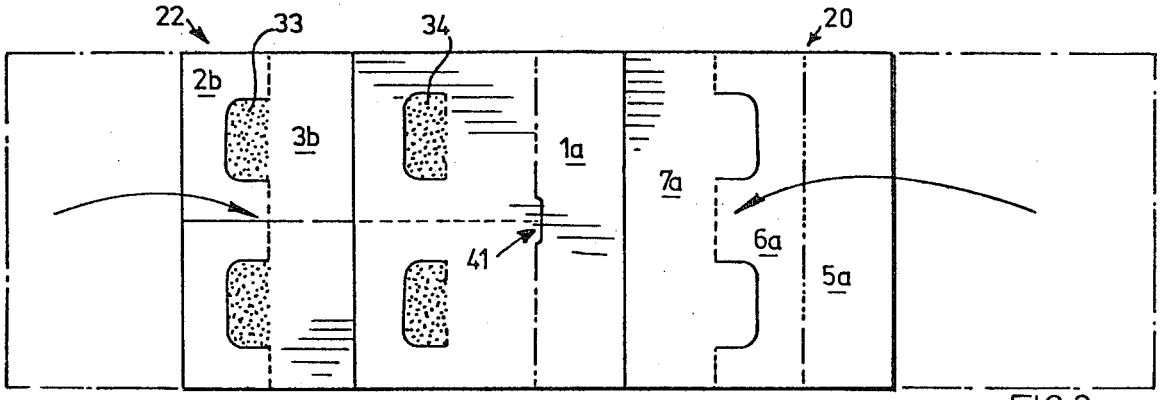
FIG. 2 shows a further step in the processing of the blank of FIG. 1.

The next step in the procedure is to apply glue or similar adhesion medium to the first pliable tab 34 within the internal portion 15, and to the back of the tab 33 in the second panel 2*b* of the leftward end portion 22. FIG. 2 shows the condition of the blank 10 after the two folding procedures have been carried out, and after glue or other adhesion medium has been applied to the tabs 34 and 33 as just described. The last-mentioned tabs are stippled in FIG. 2 to represent the application of the glue or other adhesion medium.

The last step of the procedure is to fold the entire rightward end portion 20 about the fold line separating it from the internal portion 15. In other words, the folding takes place about the line defining the rightward edge of the internal portion 15, between the portion 15 and the first panel 1*a*. This will cause adhesion of the back of the fifth panel against the back of the tab 33 in the second panel 2*b*, and will also cause adhesion of the back of the seventh panel 7*a* against the first pliable tab 34. After this folding has taken place, the space divider will appear as shown in FIG. 3.

A particular detail of the scoring and partial slitting of the blank 10 will now be described, which was not discussed earlier because it did not bear directly on the main gluing and folding procedures. As can be seen in FIG. 1, between the upper half and the lower half of the blank 10, divided by the line 12, the lines of weakness 23 and 24 at the leftward and rightward ends of the internal portion 15 deviate outwardly where they span the line 12, in order to provide finger regions 40 and 41. The finger regions 40 and 41 are defined by clean slits, and are not connected in any way to the outwardly adjacent panels 1*a* and 1*b*.

Figure 3:
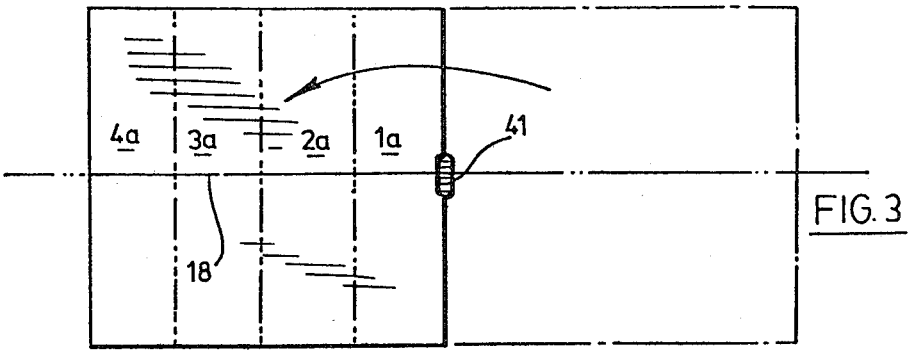
FIG. 3 shows a still further step in the processing of the blank of FIG. 1.

When the last fold has taken place, i.e. that which changes the appearance of the blank from that of FIG. 2 to that of FIG. 3, the finger portion 41 remains extending rightwardly from the fold line 24 between the internal portion 15 and the first rightward panel 1*a*. In the condition of FIG. 3, since no folding has taken place about the line 23 separating the internal portion 15 from the panel 1*b*, the finger portion 40 remains entrapped, and does not project free of the remainder of the blank, as is the case with the finger portion 41.

Figure 10:
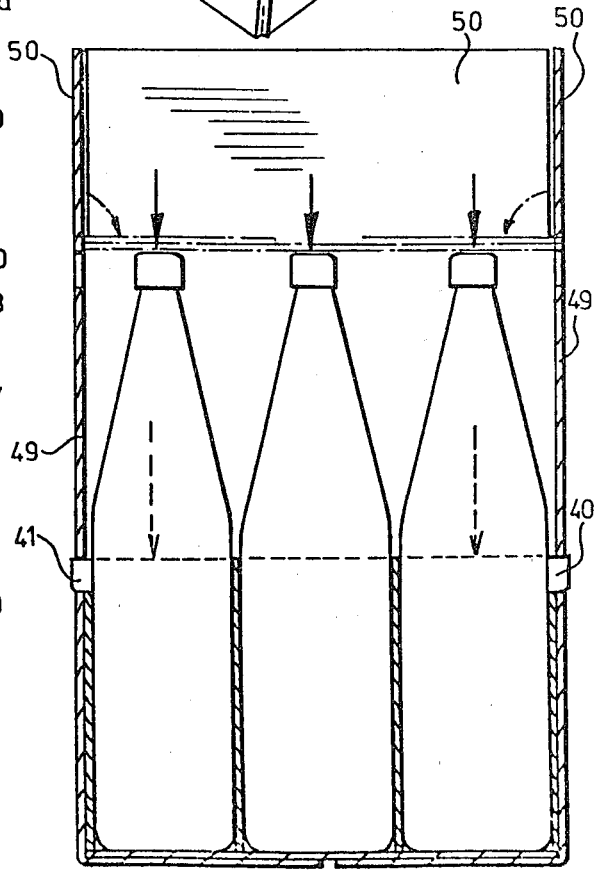
FIG. 10 is a view similar to FIG. 9, but showing the space divider in the lowermost location for shipping bottles which have been filled and capped.

It is now appropriate to point out again that, though we have discussed the provision of fold lines, tabs, and adhesive with respect only to the upper half of the blank 10, the same procedures are understood to be taking place simultaneously in the lower half of the blank of FIG. 10. Thus, the same gluing and adhesion locations exist in the lower half, as are present in the upper.

The space divider in the condition of FIG. 3 is essentially completed, and remains only to be "set-up" in order to allow it to be inserted into a carton or box of the appropriate dimensions. In the condition of FIG. 3, the space divider can be stored, shipped, etc., since the setting up of the space divider is something which is done manually at the point of assembly, and does not require a machine to be accomplished.

Figure 4:
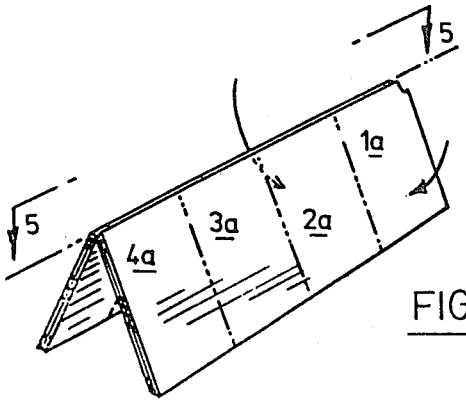
FIG. 4 is a perspective view showing the first part of the setting up procedure for the blank after it has reached the stage of FIG. 3.

Thus, the space divider arrives at the point of assembly in the condition of FIG. 3, and the subsequent steps are done manually. The first step in the setting up of the space divider is to fold the two halves about the centre line 14 dividing the upper internal portion 15 from the lower internal portion 15. In FIG. 3, the line 14 in the location of the internal portion is invisible, as it lies below the panels 1*a*–4*a* which have been folded over on top of it. If it were imagined that the space divider in the condition shown in FIG. 3 is lying on a table and that one is looking down from above, the method of setting up involves bending the upper and lower parts away from the viewer about the centre line. This can be done by picking up the space divider in the condition of FIG. 3 with one's fingers inserted under the leftward and rightward ends in line with the centre line. Pressure on the two halves away from the centre line will cause the bridge 18 and the other bridges (not visible in FIG. 3) to rupture or separate, so that the entire structure can fold about the centre line as seen in FIG. 4.

Figure 5:
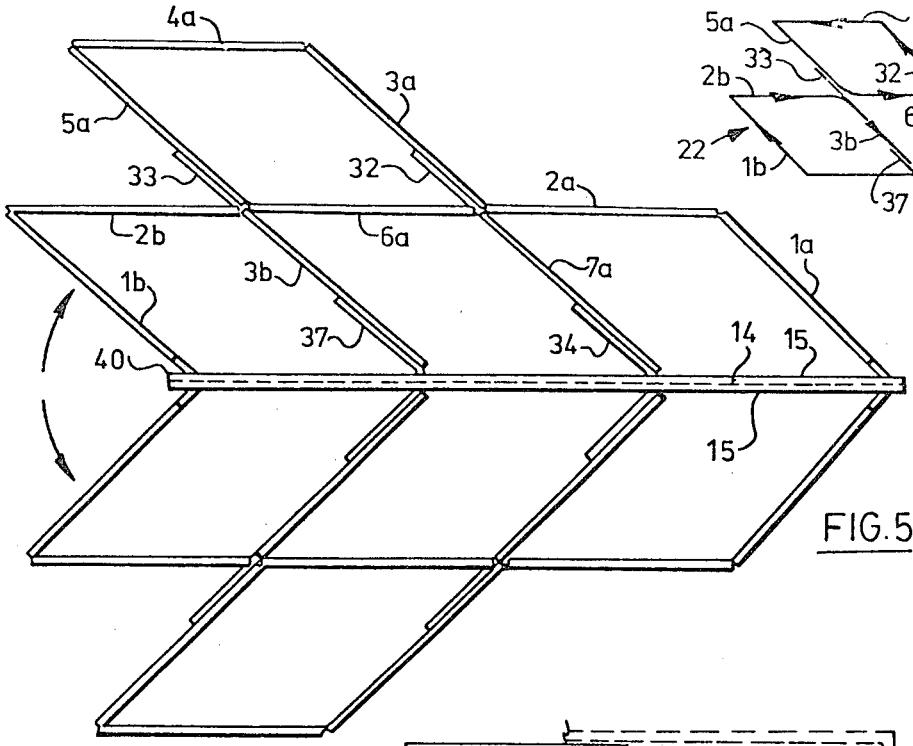
FIG. 5 is a view aligned with the various panels which the blank now defines, showing the next stage in the setting up procedure.

When the folding has been completed, the two partition halves 15 will lie against each other in back-to-back relationship. FIG. 5 is a view looking parallel with the portions 15, which are seen as very thin because they are viewed edge-on. Toward the viewer is the actual line 14.

The next step in the setting up of the space divider is to gradually swing the various interconnected panels away from their position of alignment with the internal portions 15, and a mid-way point in this procedure is shown in FIG. 5. The panels and the tabs have been identified in FIG. 5 as they are in FIG. 1, so that the structure can be understood. These identifications occur only in the upper portion of FIG. 5, in order to avoid cluttering.

Figure 6:
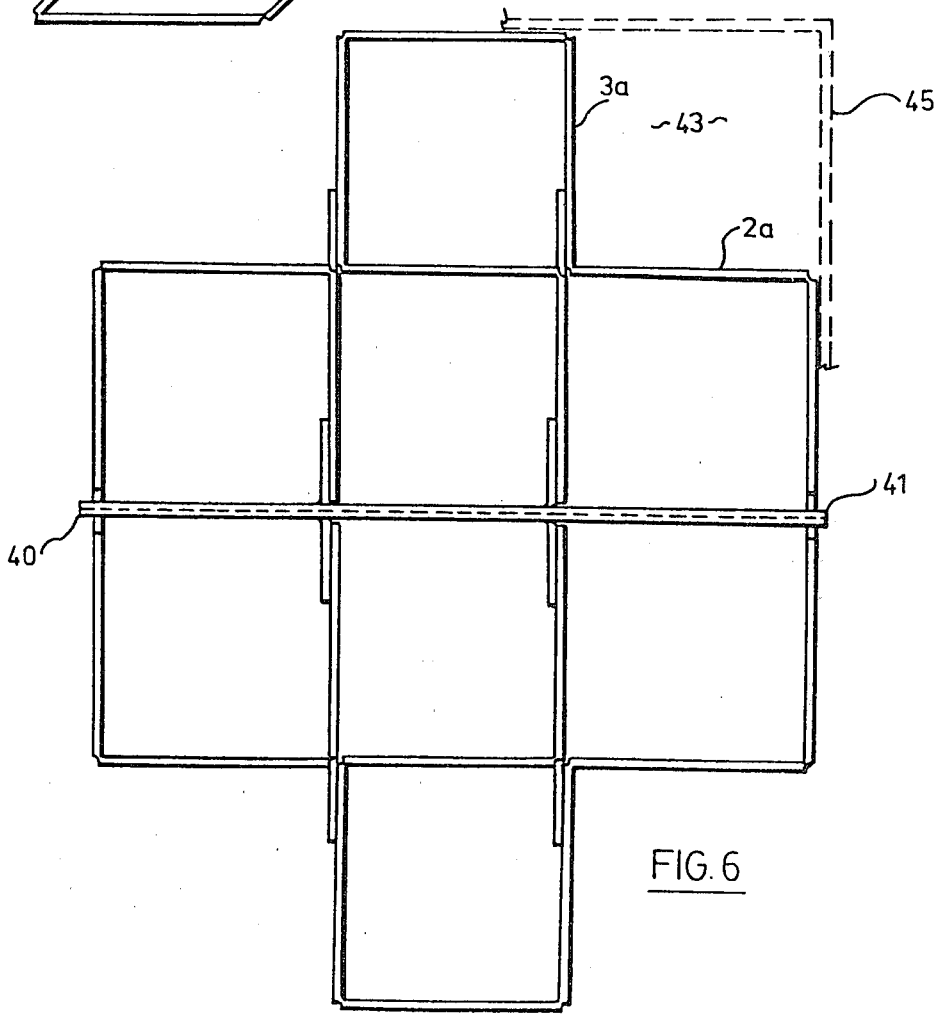
FIG. 6 shows the final stage of the setting up procedure.

As the opening up of the panels takes place, it can be seen in FIG. 5 that the finger portion 40 remains parallel with the internal portions 15. When the panel members have been swung out to a perpendicular position, as shown in FIG. 6, the finger portion 40 extends leftwardly from the completed structure in exactly the same way and to the same extent as does the other finger portion 41 at the rightward end in FIG. 6.

Figure 7:
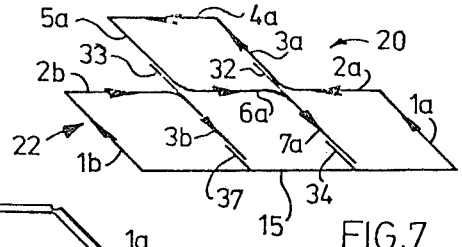
FIG. 7 is a schematic diagram helpful to clarify the way in which the various portions or panels of the blank are related to each other.

Attention is now directed to FIG. 7, which is a schematic diagram, showing clearly the relative configurations of the panels making up the rightward end portion 20, and those making up the leftward end portion 22. Arrowheads have been placed on the panels, to show the direction in which the various end portions "run" from the respective ends of the internal portion 15. These arrowheads do not represent motion, of course, but are intended to allow the viewer to understand how the panels of the end portions have been folded. It was stated in the preamble to this disclosure that it is of advantage, with machinery utilized to create space dividers of this kind, if the folding procedures do not require any backward or zig-zag folding to take place. In other words, the machine preferably is required merely to fold marginal portions inwardly. This may take place in several steps, with several folding procedures as in the present instance, but preferably there should not be any zig-zag or backwardly folded part. The reason for this is due to the greatly increased complexity required in a machine capable of folding a blank in a zig-zag pattern, because both portions of the zig-zag have to be folded simultaneously. As can be seen in FIG. 7, the panels 5*a*, 6*a* and 7*a* all extend generally from the left to the right, in the flattened condition, and represent the first fold of panels 5*a*, 6*a* and 7*a* as seen in moving from FIG. 1 to FIG. 2. The panels 1*a*, 2*a*, 3*a* and 4*a* are also aligned and stretch from the right to the left in the flattened condition, these being placed into such position at the time of the second fold when the procedures moves from the FIG. 2 condition to the FIG. 3 condition.

At the leftward end of the FIG. 7 drawing, the panels 2*b* and 3*b* at the leftward end portion 22 both extend generally from left to right when the space divider is in the flattened condition, and this arrangement takes place at the leftward end as the outward two panels are folded inwardly.

Figure 8:
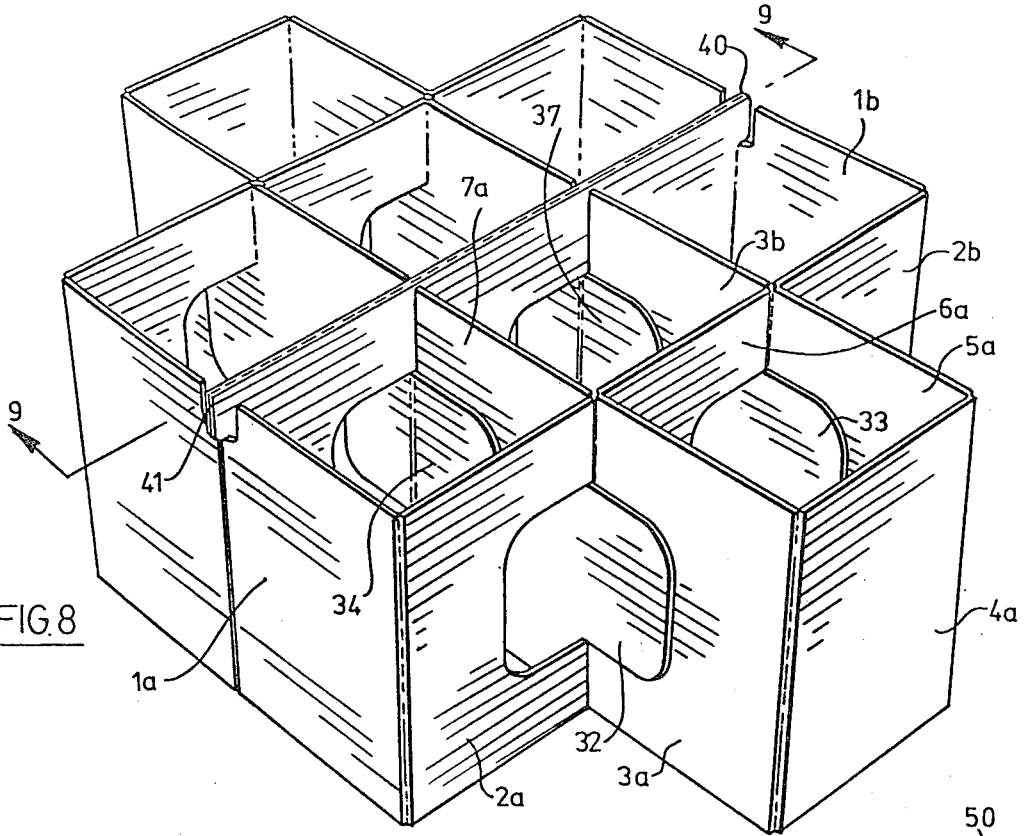
FIG. 8 is a perspective view of the set-up space divider in accordance with this invention.

Attention is now directed to FIG. 8, which shows the space divider in the final, set-up condition, ready for insertion into a carton or box of appropriate dimensions. The various portions, tabs and panels in FIG. 8 have been identified by number only in the closer or rightward portion, and these have not been duplicated in the leftward or further portion in order to avoid cluttering. It can be imagined that, with the space divider shown in FIG. 8 appropriately inserted into a rectangular box or container, a total of twelve partitioned spaces will be defined, eight of these being totally surrounded by panels of the space divider, while four are defined in the corner locations, between the appropriate panels and the corner portions of the container or box itself. This is clearly seen in FIG. 6, where the upper right hand space 43 is seen to be defined between portions of the container 45 on the one hand, and the panels 2*a* and 3*a* on the other hand.

Figure 9:
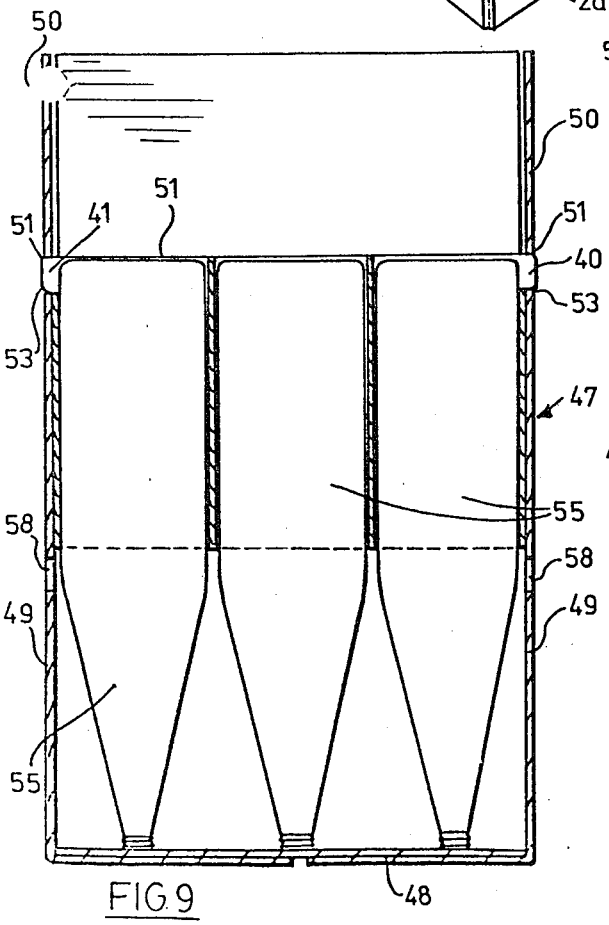
FIG. 9 is a vertical sectional view taken at 9—9 in FIG. 8, in which the space divider is located at the uppermost position for use when shipping empty bottles upside down.

In FIG. 9 is shown a carton 47 having a closed base 48, four side walls 49 (only two visible in the sectional view of FIG. 9), and an openable top composed of top flaps 50 of the usual construction.

The top flaps 50 are hinged to the remainder of the carton 47 at the usual fold lines 51, and adjacently below such fold lines 51 in two opposing side walls (the ones that are visible in section in FIG. 9) are located two apertures 53 of a width adapted to receive the fingers 40 and 41, and of a vertical depth corresponding to the depth of the fingers 40 and 41. The apertures 53 are located in the mid-way position of the walls in which they are made, so that they can receive the fingers 40 and 41. The apertures are thus of approximately the same width as the fingers 40 and 41, and are also substantially the same depth as the fingers in the longitudinal or vertical direction.

FIG. 9 shows the fingers 40 and 41 lodged into their respective apertures 53 in the side walls 49, and also shows three bottles 55 in inverted position within the box 47. As earlier stated, the inverted position for the bottles is that in which the bottles would normally be shipped empty to a filling installation. Because the bottles have a larger diameter at the base than at the upper or neck portion, the inversion of the bottles as seen in FIG. 9 will require protection essentially only in the upper part of the box 47. Thus, the space divider would be located as shown in FIG. 9 for the shipping of inverted empty bottles.

The walls 49 of the box 47 also have a second pair of apertures 58 located in alignment with but spaced below the apertures 53. The apertures 58 correspond to the position of the fingers 40 and 41 when the space divider is located in the bottom half of the box 47. This condition is shown in FIG. 10, and several bottles 55, now filled and capped, are shown in the upright position with their bases again protected from each other by the space divider.

By shaping the fingers 40 and 41 with a slightly rounded lower profile, as can be seen in the figures, it is a simple matter to move the space divider from the upper position to the lower position. The operator merely places his hand squarely and in a spread condition on top of the space divider (after the bottles have been removed, of course), and pushes downwardly. The downward push will force the fingers 40 and 41 out of the upper apertures 53, and the entire space divider will ride downwardly under the force being exerted until the fingers 40 and 41 lodge in the lower apertures 58. During this traverse, the walls 49 of the box bulge slightly outwardly due to the fact that the total distance between the outer edges of the fingers 40 and 41 is greater than the internal span between the walls 49, when the walls are unstressed.

I claim:

1. A method of handling and shipping bottle-like items having lower base portions of longer diameter and upper neck portions of smaller diameter, including the steps:

(1) providing a carton and space divider combination in which the carton is rectangular is section with four side walls, a closed base and an openable top portion, the divider having a depth less than the distance from the carton base to the carton top portion, and having partition members defining a plurality of partitioned spaces, including at least one main partition extending fully between two opposed side walls of the carton, the main partition having two projecting fingers, one at each end of the main partition, the said opposed side walls having (a) a first pair of apertures located so that the said fingers can register therewith when the divider is in a first position in the carton, and (b) a second pair of apertures aligned with but spaced from said first pair such that the divider can be moved to a second position to bring the fingers into registry with said second pair, the divider in the first position being adjacent the top portion of the carton, the divider in the second position being adjacent the base of the carton, (2) placing the divider in the carton in said first position, (3) loading a plurality of said bottle-like items into the carton in the spaces defined by said divider, with the neck portions down so that the base portions are protected from scraping against each other by the presence of the divider, (4) closing the carton top portion and shipping the carton and its contents to a filling location, (5) at the filling location, opening the carton top, removing the said items, and filling and capping them, (6) moving the divider in the carton from said first to said second position, (7) loading the filled and capped bottle-like items back into the container with the base portions down so that again the base portions are protected from scraping against each other by the presence of the divider, and (8) closing the carton top portion for further shipment of the now filled bottle-like members.

* * * * *